US005718181A

United States Patent [19]

Shinozuka et al.

[11] Patent Number: 5,718,181

[45] Date of Patent: Feb. 17, 1998

[54] BOBBIN EXCHANGER

[75] Inventors: Toshinobu Shinozuka; Tsutomu Okubo, both of Tokyo, Japan

[73] Assignee: Juki Corporation, Tokyo, Japan

[21] Appl. No.: 587,278

[22] Filed: Jan. 18, 1996

[30] Foreign Application Priority Data

Jan. 18, 1995 [JP] Japan ..... 7-23525
Jan. 18, 1995 [JP] Japan ..... 7-23527

[51] Int. Cl.[6] ..... D05B 57/26; D05B 57/00

[52] U.S. Cl. ..... 112/186; 112/279; 112/282; 112/180

[58] Field of Search ..... 112/186, 279, 112/180, 282

[56] References Cited

U.S. PATENT DOCUMENTS

| | | | |
|---|---|---|---|
| 3,376,838 | 4/1968 | Schiffmacher et al. . | |
| 4,002,130 | 1/1977 | Rovin et al. . | |
| 4,186,677 | 2/1980 | Sacchetti | 112/186 |
| 4,223,618 | 9/1980 | Cislak . | |
| 4,681,050 | 7/1987 | Kosmas . | |
| 5,143,004 | 9/1992 | Mardix et al. . | |
| 5,582,355 | 12/1996 | Nakamura et al. | 112/186 X |
| 5,603,273 | 2/1997 | Nakamura et al. | 112/186 |

FOREIGN PATENT DOCUMENTS

| | | |
|---|---|---|
| 1-91898 | 4/1989 | Japan . |
| 4-7072 | 1/1992 | Japan . |
| 5-68764 | 3/1993 | Japan . |
| 5-192476 | 8/1993 | Japan . |
| 6-54977 | 3/1994 | Japan . |
| 6-210089 | 8/1994 | Japan . |

*Primary Examiner*—Paul C. Lewis
*Attorney, Agent, or Firm*—Morgan & Finnegan, L.L.P.

[57] ABSTRACT

An automatic bobbin exchanger, to be incorporated into a sewing machine, automatically replaces a bobbin case having a bobbin with a small amount of remaining lower thread, with a bobbin case having a fully wound lower-thread bobbin. The automatic bobbin exchanger includes a pair of two dummy shafts and a rotary arm having a grip mechanism for releasably holding a bobbin case. The dummy shafts are provided at positions opposable to a moving path of the rotary arm. One of the dummy shaft holds a fully wound bobbin and the other holds a bobbin with a small amount of the remaining lower thread. Preferably, a remaining-thread mover unit which completely removes the small amount of remaining lower thread around the bobbin and a lower-thread winder which winds lower thread around the empty bobbin may be provided at positions opposable to a moving path of the rotary arm.

24 Claims, 13 Drawing Sheets

BOBBIN EXCHANGER

BACKGROUND OF THE INVENTION

1. Field of the Invention

The present invention relates to a bobbin exchanger to be installed in a sewing machine which automatically replaces a bobbin in the sewing-machine shuttle.

2. Description of the Related Art

Among sewing machines which sew and form a seam with upper and lower thread, industrial high-speed sewing machines particularly consume a large amount of lower thread and require frequent replacements of a lower-thread bobbin. Usually, the bobbin replacement has been conducted manually: an operator stops the sewing machine, takes off the bobbin case from the shuttle, disengages the bobbin from the bobbin case, replaces it with another wound lower-thread bobbin, and packs the other bobbin into the bobbin case. Alternatively, the operator winds the lower thread around the empty bobbin in the bobbin case which has been taken off from the shuttle, and returns the same bobbin to the bobbin case.

U.S. Pat. No. 3,981,256 discloses another exchange method for preparing many sets of bobbins and bobbin cases, loading these sets as cassettes into the sewing machine, and automatically replacing a bobbin in use when its lower thread decreases, with a next set of bobbin and bobbin case.

However, such manual replacement disadvantageously requires the operator to repeat arduous replacement operations many times. Such manual replacement also results in long non-operating time for the sewing machine which causes extremely poor productivity. The cassette method, which prepares many bobbins and bobbin cases increases the cost, also disadvantageously renders the unit size bulky, complicates and narrows the structure around the shuttle, and prevents smooth repairs and inspections of the sewing machine.

More recently, U.S. Pat. No. 5,143,004 and WO 84/03310 have proposed still another exchange method for removing an empty bobbin from the bobbin case which has been detached from the shuttle, loading another wound lower-thread bobbin into the bobbin case, and returning the bobbin case to the shuttle. However, the method requires, when the bobbin which has been removed from the bobbin case is returned to the bobbin case, a specific structure and an extra device for precisely positioning the bobbin case with the bobbin, i.e., for according a bobbin support shaft of the bobbin case with the bobbin's center hole.

With the foregoing in mind, applicant has proposed, in Japanese Laid-Open Patent Application No. 5-192476, a device which removes the remaining lower thread around the bobbin while keeping the bobbin in the bobbin case even after the bobbin case is taken off from the shuttle, and guides the newly wound lower thread to the outside of the bobbin case through the predetermined thread path of the bobbin case, (this operation being generally referred to as a threading operation). Nevertheless, since this device arranges, opposite to the shuttle, a support unit which supports a mechanism for taking off a bobbin case from the shuttle, the array around the shuttle becomes complex and bulk, preventing the smooth repairs and inspections of the sewing machine.

Applicant has also proposed another device in Japanese Laid-Open Patent Application No. 7-80176. FIG. 16 shows its basic systematic structure. The device arranges, with a regular interval around guide shaft 50 below the sewing-machine bed, bobbin-case exchange portion A having shuttle 1, remaining thread removing portion G having remaining-thread remover 61 which removes remaining lower thread upon bobbin, and lower thread winding portion H having a lower-thread winder 62 which winds lower thread around the bobbin 7, threads the bobbin case, and cuts the lower thread for the bobbin case. Guide shaft 50 is rotatably supported on main base 100, and sustains rotary arm 51 at its middle portions whereby the rotary arm 51 is movable along and rotatable around the guide shaft 50. The rotary arm 51 advances and retreats along the shaft 50 because of lever 52 which is moved back and forth by electromagnet 101. The rotary arm 51 is rotated, at the advance position, in forward and backward direction by a rotation drive unit which includes a motor (not shown).

Provided near both ends of the rotary arm 51 are a pair of grip means (not shown) for releasably holding bobbin case 2 with the bobbin 7. The grip means and the rotary arm 51 constitute bobbin exchanger. Means disclosed in U.S. Pat. No. 3,981,256 and U.S. No. 3,376,838 are applicable to the grip means, and applicant has already proposed a grip unit in Japanese Laid-Open Patent Application No. 6-304369.

Referring to FIG. 15, when the rotating rotary arm 51 is rotated to a position opposite to the shuttle 1, and advances and/or retreats there, the grip means takes off the bobbin case 2 from the shuttle 1 or loads a new bobbin case 2 into the shuttle 1. When the rotary arm 51 is positioned at the remaining thread removing portion G, the remaining-thread remover 61 removes the remaining lower thread around the bobbin 7 in the bobbin case which has been held by the grip means. U.S. patent application Ser. No. 08/388,034 has proposed one example of the remaining-thread remover. When the rotary arm 51 is positioned at the lower thread winding portion H, the lower-thread winder 62 winds thread around the bobbin 7 in the bobbin case 2, threads the thread path of the bobbin case, and cuts the lower thread between the bobbin case and a thread supply source. U.S. patent application Ser. No. 08/279,866 has also proposed one example of the lower-thread winder 62.

Nonetheless, applicant's earlier proposals and the aforementioned devices and methods still suffer from several disadvantages. First, the main base protrudes around the shuttle so as to support both ends of the guide shaft which sustains the rotary arm, obstructing the maintenance and adjustment operations, e.g., an alteration of the shuttle, and decreasing the operational efficiency.

Second, such sewing machines require operator's manual operations through hole 102 on a sewing table shown in FIG. 16 to load the bobbin case into and eject or unload it from the shuttle and the grip means at the top of the rotary arm whenever we attempt to initiates a sewing or maintenance operation or to change a color of the lower thread. However, since the grip means faces the shuttle, it is necessary for the operator to turn their palm or use the other hand so as to load the bobbin case into or ejecting (or unloading) it from the shuttle and the grip means sequentially. Such inconvenience not only lessens the operational efficiency, but also increases risks that the bobbin case drops and gets damaged and/or the bobbin gets uncoupled and dirty in thread.

Third, these devices include a pair of grip means at both ends of the rotary arm, and sustain the center of the rotary arm pivotally around the shaft. Such a structure requires a wide rotational area for the rotating arm and prevents the device from being made smaller.

Even in the grip unit disclosed in Japanese Laid-Open Patent Application No. 6-304369, the incomplete centering between the shuttle and the grip means during the assembly process causes an inaccurate fitting between the shuttle axis and the center-hole axis of the bobbin case, hindering the bobbin case from being smoothly loaded into and/or ejected from the shuttle, resulting in lots of time to execute the centering, complicating the assembly process, and rendering the unit expensive. In addition, the unit cannot properly handle with any manufacturing errors in the bobbin case, changes with the passage of time, different specifications of manufacturers, decreasing the reliability such that the bobbin cannot be removed or the bobbin cannot be held when the bobbin case is attempted to be taken off from the shuttle.

SUMMARY OF THE INVENTION

Accordingly, it is a general object of the present invention to provide a novel and useful bobbin exchanger in which the above disadvantages are eliminated.

Another and more specific object of the present invention is to provide a bobbin exchanger which improves the operational efficiency by facilitating loading/ejecting manual operations for the bobbin case, prevents dropping off of the bobbin and bobbin case during the operations, shortens the radius of rotation for the rotating arm to save space and miniaturize the unit size, and reduces the number of the components, e.g., bobbin-case grip means, rendering the device less expensive.

Still another object of the present invention is to provide a bobbin exchanger which achieves an automatic bobbin exchange with single grip mechanism, improving the operational efficiency and productivity.

Another object of the present invention is to provide a bobbin exchanger which assures the loading/ejecting operations between the bobbin case and shuttle, while holding the bobbin case without leaving alone the bobbin, even when there is an offset in centering between the shuttle and the grip mechanism, reduces the assembly time for positioning, and/or even when the bobbin case includes a manufacturing error, a change with the passage of time, and a different specification of the manufactures.

Other objects and further features of the present invention will becomes readily apparent upon review of the following description of the preferred embodiments and accompanying drawings.

DETAILED DESCRIPTION OF THE PREFERRED EMBODIMENTS

Figure 1:
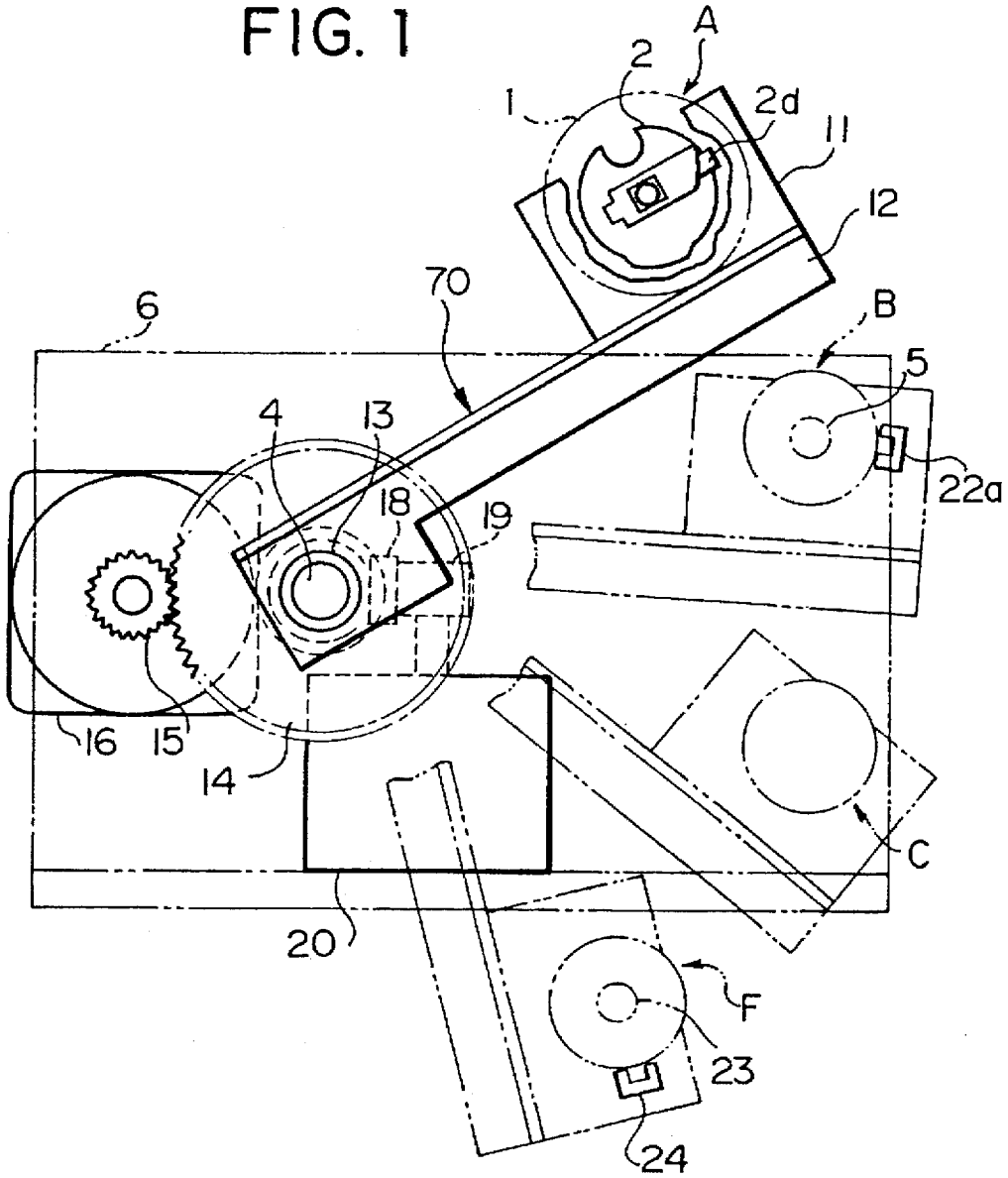
FIG. 1 is a front view of a bobbin exchanger of a first embodiment of the present invention.

A description will now be given of the first embodiment of the present invention with reference to FIGS. 1 and 2.

The shuttle 1 supports the bobbin case 2 ejectably through middle-shuttle shaft 3. The shuttle 1 is fixed onto rotary shaft 21 which is associated with drive means (not shown) of the sewing machine. As disclosed in U.S. Pat. Nos. 5,109,783 and 4,235,178, the bobbin case 2 has tab 2*d* which is engageable with stopper groove 3*a* near the top of the middle-shuttle shaft 3 to hold the bobbin case 2 at the middle-shuttle shaft 3, and positions the bobbin case 2 to the shuttle 1.

Base plate 6 stands firmly upon a main base (not shown) attached to a sewing-machine body below and behind (although above in FIG. 2) the shuttle 1. Carrier shaft 4, parallel to the rotary shaft 21, is fixed and overhung at proximal end 4*a* on the base plate 6.

Distal end 4*b* of the carrier shaft 4, apart from the base plate 6, supports hollow and cylindrical carrier bush 13 pivotally around and movably along its axis. Gear 14 and a proximal end of carrier arm 12 are secured at the top portion of the carrier bush 13. The carrier arm 12 has holder 11 at the top thereof and at a surface facing the shuttle 1. The holder 11 includes grip mechanism which will be discussed later with reference to FIGS. 6 through 8(*c*). The carrier arm 12 and the holder 11 constitute rotary arm 70.

Linear collar 17 is rotatable around the carrier bush 13, but unmovable in the axial direction between stop ring 30 and the gear 14 which are secured onto the carrier bush 13. Rack 18 is secured to the circumference of the collar 17 in the axial direction. Rotary motor 20 is secured onto the main base with its output shaft orthogonal to the carrier shaft 4. The motor 20 secures, at the top of its output shaft, pinion 19, and the pinion 19 is geared with the rack 18. When the rotary motor 20 is driven, the rack 18 and the pinion 19 move, along the carrier shaft 4, the collar 17, the carrier bush 13, and the rotary arm 70 supported by the carrier bush 13. As a consequence, the bobbin case 2 supported on the holder 11 moves between a loading/ejecting position in the shuttle 1 and an evacuation position apart from the shuttle 1 in the axial direction.

Figure 2:
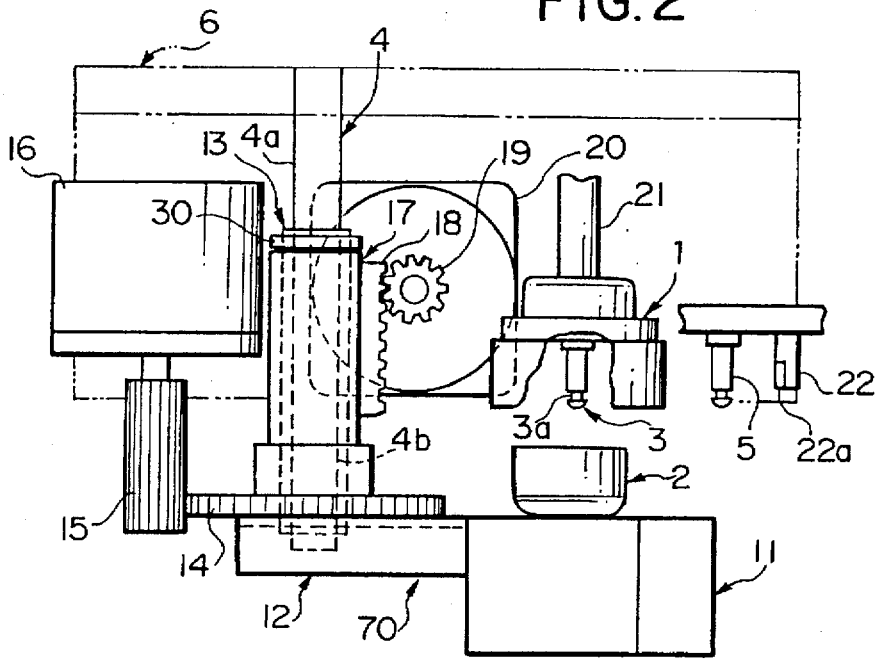
FIG. 2 is a plan view of the bobbin exchanger shown in FIG. 1.

The gear 14 is engaged with rotary motor gear 15 whose teeth are long enough in the shuttle axis direction to cover, as shown in FIG. 2, the loading/ejecting position and evacuation position. The motor gear 15 is secured to an output shaft of rotary motor 16. The motor 16 is fixed on the main base and is rotatable in forward-reverse directions or in one direction.

Thus, when the rotary motor 16 is driven, the carrier bush 13 is rotated through the gears 14, 15, and the rotary arm 70 supported by the carrier bush 13 is rotated when the rotary arm 70 is located at the evacuation position (shown in FIG.

2). Although the carrier shaft 4 is supported only at its proximal end 4*a* on the main base, the continuous engagement between gears 14, 15 in the axial direction shaft 4 substantially maintain the supporting strength.

Bobbin-case holding mechanism, which comprises dummy shaft 5 and rotation stopper 22, is secured to the base plate 6 at position B which is opposable to the rotated holder 11. The standing dummy shaft 5 has substantially the same structure as that of the middle-shuttle shaft 3, and is to hold the bobbin case 2 with the bobbin 7 ejectable in the axial direction. The rotation stopper 22, which stands opposite to the dummy shaft 5, has stopper groove 22*a* engageable with the bobbin-case tab 2*d*, whereby the bobbin case 2 is held while keeping the predetermined position to the dummy shaft 5.

The remaining-thread remover is located at another position F which is opposable to the rotated holder 11 but different from the position B. A device disclosed in U.S. patent application Ser. No. 08/388,034 is applicable to the remaining-thread remover. However, the instant remaining-thread remover differs from the above devices in that it has the bobbin-case holding mechanism and the rotation stopper 24, and the remaining thread is removed while the bobbin case is held at the holding shaft 23 having the same structure as that of the dummy shaft 5.

A lower-thread winder, the same as the lower-thread winder 62 disclosed in U.S. patent application Ser. No. 08/279,866, is located at position C between the positions B and F on the rotating locus of the holder 11. The base plate 6 is appropriately notched so that the remaining-thread remover 61 does not bump against the remaining-thread remover and the lower-thread winder 62.

According to this embodiment, the grip mechanism of the holder 11 sets the evacuation point (shown in FIG. 2) as an origin. The rotary motor 16 uses a pulse motor; the number of pulses of the pulse motor is counted and used to control rotation of the grip mechanism to shuttle position A, lower-thread winding position C, remaining-thread removing position F, and dummy position B.

A description will now be given of the operation of this device. Initially, the shuttle 1 is not loaded with the bobbin case. The operator manually loads bobbin case 2A with a fully wound lower-thread bobbin, into the dummy shaft 5 from the side of the rotary arm 70, and another bobbin case 2B with a fully wound lower-thread bobbin, into the holding shaft 23 from the side of the rotary arm 70.

The rotary arm 70 returns, when a power switch is on, to the origin and rotates, when the operator turns on a start switch (not shown), until the holder 11 is opposed to the dummy position B or the remaining-thread removing position F. Hereupon, this embodiment picks up the dummy position B for convenience. Then, the rotary arm 7 advances, whereby the grip mechanism of the holder 11 holds the bobbin case 2A at the dummy shaft 5. Thereafter, the rotary arm 70 retreats and rotates until it opposes the holder 11 with the bobbin case 2A to the shuttle 1. As the rotary arm 70 advances, the bobbin case 2A is loaded into the shuttle 1; then the rotary arm 70 retreats.

The subsequent sewing operation is suspended by a bobbin exchange command which may be a detection signal from means for detecting the remaining amount of lower thread around the bobbin. In response, the rotary arm 70 starts to advance, whereby the grip mechanism of the holder 11 holds the bobbin case 2A and the bobbin with decreased lower thread. When the rotary arm 70 retreats, the bobbin case 2A is ejected from the shuttle 1. Thereafter, the rotary arm 70 rotates until it opposes the holder 11 to the dummy shaft 5, then advances to load the bobbin case 2A into the dummy 5, and finally retreats.

Subsequently, the rotary arm 70 rotates until it opposes the holder 11 to the holding shaft 23, then advances to make the grip mechanism of the holder 11 holds the bobbin case 2B with a fully wound lower-thread bobbin at the holding shaft 23. As the rotary arm 70 retreats, the bobbin case 2B is taken out of the holding shaft 23.

When the rotary arm 70 rotates until it opposes the holder 11 to the shuttle 1, and then advances to load the bobbin case 2B into the shuttle 1, and finally retreats. The interruption of the sewing operation is released.

When the sewing operation is resumed, the rotary arm 70 rotates, during the sewing operation, until it opposes the holder 11 to the dummy shaft 5, and then advances to make the grip mechanism hold the used bobbin case 2A at the dummy shaft 5, and retreats to remove the bobbin case 2A from the dummy shaft 5.

Next, the rotary arm 70 rotates to the position F where the holder 11 stands opposite to the remaining-thread remover, and then advances to load the held bobbin case 2A into the holding shaft 23. As the rotary arm 70 retreats, the remaining-thread remover removes the remaining lower thread around the bobbin in the bobbin case 2A to vacates the remaining thread around the bobbin.

Next, the rotary arm 70 rotates to the position C where the holder 11 stands opposite to the lower-thread winder, and then advances. The lower-thread winder activates while the bobbin case 2A is held by the holder 11, whereby the lower-thread winder winds the predetermined amount of lower thread around the bobbin in the bobbin case 2A, threads the bobbin case 2A, and cuts the lower thread.

When lower thread is properly wound around the bobbin, the rotary arm 70 retreats with the holder 11 holding the bobbin case 2A, rotates until it opposes the holder 11 to the dummy shaft 5, and advances to temporarily hold the bobbin case 2A at the dummy shaft 5. The rotary arm 70 then rotates.

The rotary arm 70 stands by with this state. The sewing operation is interrupted in response to the next bobbin exchange command, and the rotary arm 70 rotates until it opposes the holder 11 to the shuttle 1, and then advances to remove from the shuttle 1 the bobbin case 2B having the bobbin with a smaller amount of remaining lower thread. The rotary arm 70 then retreats.

Then, the rotary arm 70 rotates until it opposes the holder 11 to the holding shaft 23 of the remaining-thread remover, and then advances to make the holding shaft 23 hold the bobbin case 2B. The rotary arm 70 then retreats. Next, the rotary arm 70 rotates until it opposes the holder 11 to the dummy shaft 5, and advances to hold the bobbin case 2A at the dummy shaft 5 by the grip mechanism. Next, the rotary arm 70 retreats, rotates until the holder 11 with the bobbin case 2A is opposed to the shuttle 1, and advances to load the bobbin case 2A into the shuttle 1, and finally retreats. These procedures will be repeated in the subsequent steps.

Alternatively, at the initialization of the above procedures, the operator may manually load, through the rotary arm, a bobbin case with a fully wound lower-thread bobbin into one of the dummy shaft 5 and the holding shaft 23, and another bobbin case with an empty bobbin into the other shaft. The bobbin case with the empty bobbin is to be moved to the lower-thread winder to newly wind the lower thread around the bobbin during the sewing operation using the bobbin case with the wound lower-thread bobbin, and is made to stand by at one of the shafts 5, 23.

In an attempt to sew with different color lower thread during the sewing operations, the operator puts his hand from the rotary-arm side and loads the bobbin case 2A containing a different color lower-thread bobbin into one of the shafts 5, 23 without turning his palm. After the rotary arm 70 rotates until it opposes the holder 11 to the shuttle 1, the rotary arm 70 advances to make the grip mechanism hold the bobbin case 2B in the shuttle 1, and then retreats. Subsequently, the rotary arm 70 rotates until it stands opposite to the other one of the shafts 5, 23 which does not have any bobbin case, and then advances to load the bobbin case 2B into the other shaft. Then, the rotary arm 70 retreats and rotates until it opposes the holder 11 to one of the shafts 5, 23 which holds the bobbin case 2A containing the different color lower-thread bobbin. Then, the rotary arm 70 advances to hold the bobbin case 2A, rotates until it opposes the holder 11 to the shuttle 1, and advances to load the bobbin case 2A into the shuttle 1. Thus, the sewing with the different color lower thread becomes ready.

If it is necessary to use the original color lower-thread bobbin, the bobbin case 2A in the shuttle 1 is transferred in the same procedures to empty one of the shafts 5, 23, and the bobbin case 2B is reset from the other one of the shafts 5, 23 and reloaded into the shuttle 1.

In an attempt to take off the bobbin case from the grip mechanism of the holder 11, the holder 11 is opposed to the shaft 5 or 23 and advanced, the bobbin case is transferred to the shaft 5 or 23. As is similar to the removal of the bobbin case from the middle-shuttle shaft 3, the operator puts his hand from the rotary-arm side and removes the bobbin case from the shaft 5 or 23 without turning his palm.

This embodiment reduces obstacles for an operator's hand to be put around the rotary arm 70 equipped with the grip mechanism by overhanging, below the shuttle 1, the carrier shaft 4 which supports the rotary arm 70, at the base plate 6, easing loading of the bobbin case 2 into and ejecting of it from the grip mechanism, increasing the operational efficiency and preventing the drop off of the bobbin 7 and the bobbin case 2 while the bobbin case 2 is loaded and ejected.

In particular, since the bobbin exchanger of the present invention provides the grip mechanism with one end of the rotary arm 70 and carrier shaft 4 with the other end of the rotary arm 70, the radius of rotation for the rotary arm 70 is made smaller than that in a case where the rotary arm 70 is rotated around its almost middle portion. The number of components, e.g., the grip mechanism, is also reduced from plurality to single, maximizing the space, and rendering the unit small and inexpensive.

Although only one grip mechanism and only one dummy shaft which is to hold the bobbin case 2 are insufficient to automatically conduct the above procedures, the instant embodiment arranges the remaining-thread remover, lower-thread winder, and at least two or more dummy shafts 5, 23 at positions opposable to the rotated grip mechanism, and automatizes all the operations including loading of the bobbin case 2 into and ejecting it from the shuttle 1, removing the remaining thread on the bobbin 7, winding lower thread around the bobbin 7, threading the bobbin case 2, cutting the lower thread for the bobbin case 2, temporarily clutching the bobbin case 2 at one of the dummy shafts 5, 23 which is indispensable among a series of these operations with only one grip mechanism, improving the operational efficiency and the productivity.

The bobbin exchange may be automatized even if there is no remaining-thread remover and lower-thread winder. In order to automatize the bobbin exchange with only one grip mechanism, the bobbin exchanger requires two or more dummy shafts, e.g., a dummy shaft for holding a bobbin case to be loaded into the shuttle 1, and a dummy shaft for holding a bobbin case to be detached from the shuttle 1. Since the dummy shafts 5, 23 are arranged at positions opposable to the rotated grip mechanism, as discussed above, the bobbin exchanger can be automatized.

Due to the shafts 5, 23 which hold the bobbin case 2 with bobbin 7 at positions opposable to rotated grip mechanism, the operator loads the bobbin case 2 into the shaft 5 or 23 without turning his palm to loads the bobbin case 2 into the grip mechanism through the advance/holding operations of the grip mechanism. In addition, the operator makes the bobbin case 2 to be held by the shaft 5 or 23 through the advance/release operations of the grip mechanism, and takes off the bobbin case 2 without turning his palm. Anyway, it is not necessary for the operator to turn his palm so as to load/eject the bobbin case 2 into/from the grip mechanism, facilitating the operations, and preventing the dropping off of the bobbin 7 and the bobbin case 2 during the loading/ejecting operations of the bobbin case 2.

Moreover, as discussed above, at least two dummy shafts are required for automatization, but the instant embodiment makes one of the dummy shafts serve as the shaft 23, reducing the number of components, saving the space, and rendering the device less inexpensive and smaller.

Meanwhile, the grip mechanism holds the bobbin case in the prior art lower-thread winder; in other words, the bobbin case is transferred to the lower-thread winder to be held. Therefore, the lower-thread winder cannot serve as the dummy shaft.

Advantageously, the evacuation position for the grip mechanism is set as an origin retrieval position and the grip mechanism is prevented from bumping with obstacles, e.g., a shuttle, when retrieving the origin through the retreat/rotating operations. Therefore, the grip mechanism returns to the origin smoothly.

Figure 3:
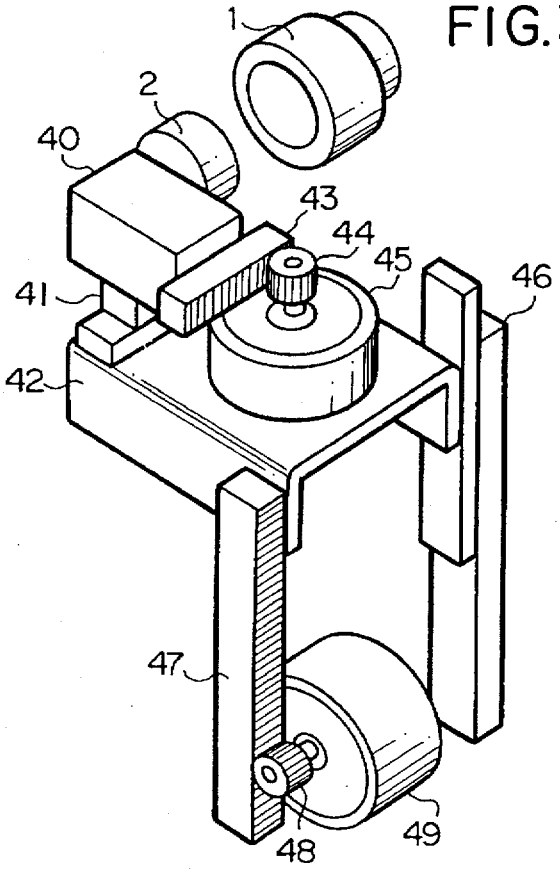
FIG. 3 is a perspective view of a bobbin exchanger of a second embodiment of the present invention.
Figure 4:
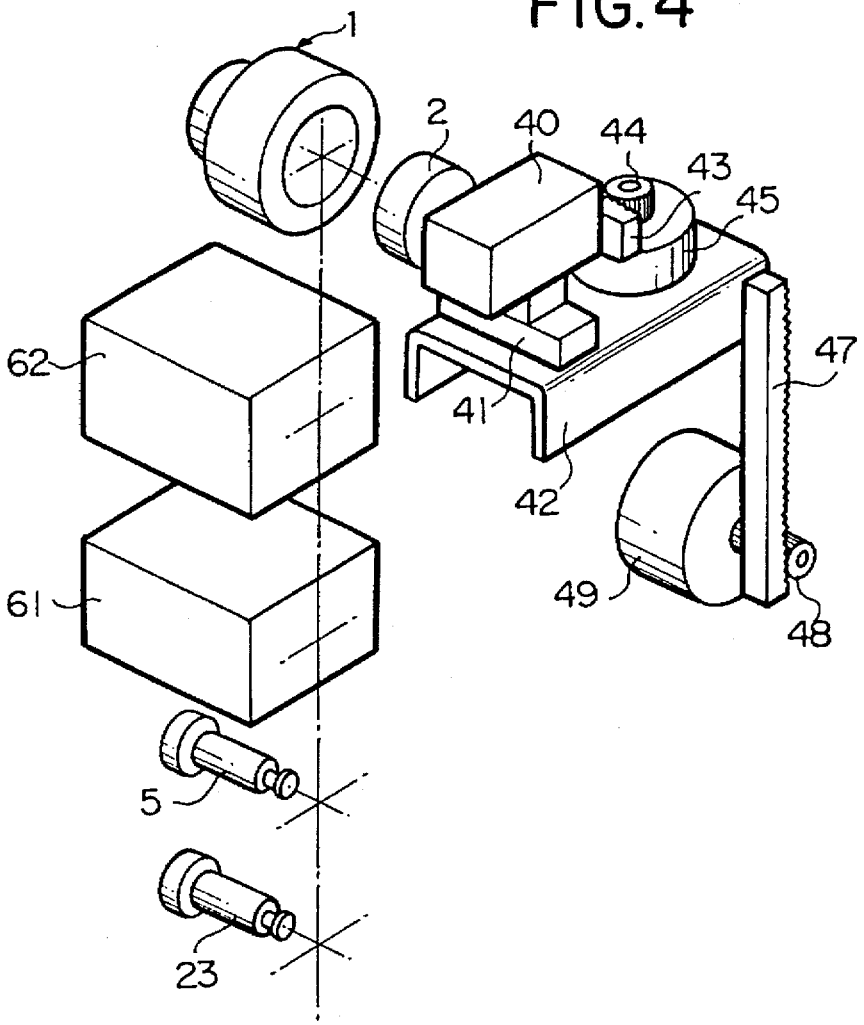
FIG. 4 is a perspective view of the bobbin exchanger viewed from its rear surface.

FIG. 3 is a perspective view of a bobbin exchanger of a second embodiment of the present invention. FIG. 4 is a perspective view of the bobbin exchanger viewed from its rear surface. Those elements which are the same as corresponding elements in the previous embodiment and the prior art description are designated by the same reference numerals.

This embodiment provides the similar grip mechanism to that of the previous embodiment with grip unit 40 which is guided by horizontal slide mechanism 41 and movable parallel to the shuttle axis. The grip unit 40 secures rack 43 thereto which extends parallel to the shuttle axis and is geared with pinion 44. The pinion 44 is secured to an output shaft of horizontal motor 45 which serves as first mobile means.

Carrier base 42 is guided and movable in the longitudinal direction by vertical slide mechanism 46 which stands on the main base. The carrier base 42 is coupled to rack 47 which extends in the longitudinal direction. The rack 47 is geared with pinion 48 which is secured to an output shaft of vertical motor 45 which serves as second mobile means. Arranged below the shuttle 1 from the top to the bottom in FIG. 4 are lower-thread winder 62, remaining-thread remover 61, and dummy shafts 5, 23.

When the vertical motor 49 starts, the grip mechanism moves linearly in the longitudinal direction and faces the shuttle 1, the lower-thread winder 62, the remaining-thread remover 61, and the dummy shafts 5, 23. On the other hand, when the horizontal motor 45 starts, the grip mechanism moves linearly parallel to the shuttle axis to advance and retreat further than the shuttle 1, the lower-thread winder 62, the dummy shafts 5, 23. If necessary, it is advanced and retreated further than the remaining-thread remover 61.

Although the second embodiment arranges the dummy shafts 5, 23 for holding the bobbin case 2 with the bobbin 7 at positions opposable to the grip mechanism moved by vertical motor 49 rather than the rotated grip mechanism, this embodiment also acquires the same effects as those of the previous embodiment, namely, automatic bobbin exchange operation with only one grip mechanism and a pair of dummy shafts 5, 23. Of course, this embodiment also has other effects, i.e., rendering the device less expensive by reducing the number of the components, e.g., the grip mechanism, and simplifying the loading/ejecting of the bobbin case 2 into/from the grip mechanism without turning operator's palm during these operations.

Figure 5:
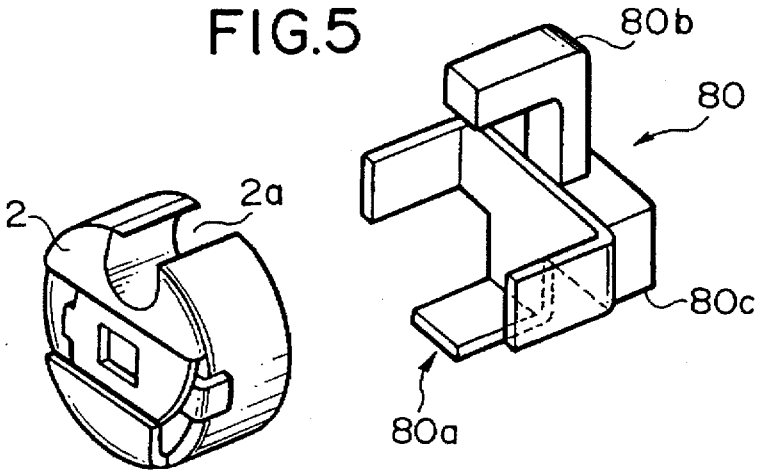
FIG. 5 is a perspective view of another example of bobbin-case holding mechanism.

The present invention is not limited to these first and second embodiments, and various variation and modifications may be made within the scope of the present invention. For instance, the bobbin-case holding mechanism may be composed, besides the dummy shafts 5, 23, of bobbin-case holding mechanism 80 which includes holder 80*a* for housing the bobbin case 2, rotation stopper 80*b* which stops rotation of the bobbin case 2 when the bobbin case 2 is loaded into the holder 80*a*, and magnet 80*c* which is provided at the rear surface of the holder 80*a* and magnetically abstracts the bobbin case 2, as shown in FIG. 5. Thus, notch 2*a* on the bobbin case 2 is engageable with the rotation stopper 80*b* and assists to hold the bobbin case 2. Also, an actuator, for example a solenoid or an air cylinder, may be substituted with the linear motor 20 in the first embodiment which moves the rotary arm 70 along the carrier shaft 4. The motor 16 in the first embodiment which rotates the rotary motor 70 may be replaced with another drive means. The number of the means is not limited to two, and may be more than two. The grip mechanism do not have to serve as holding shaft 23. The dummy position B, the lower thread winding position C, and the remaining thread removing position F may be placed to other positions as long as they are positions opposable to the moving grip mechanism.

A description will be given of a third embodiment of the present invention. Those elements in FIGS. 6 through 15 which are corresponding elements in the previous embodiments are designated by the same reference numerals.

Figure 9:
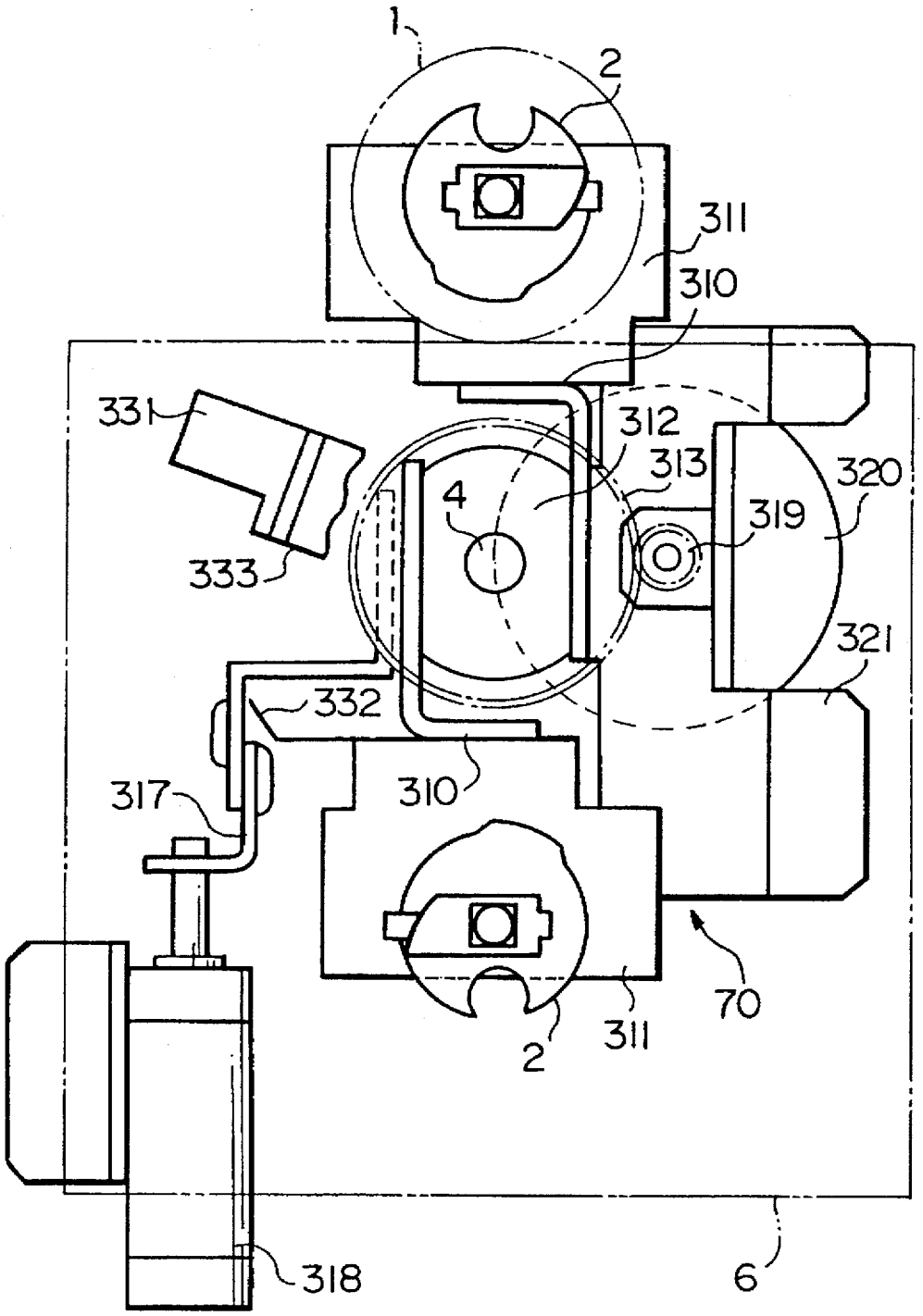
FIG. 9 is a front view of a bobbin exchanger of a third embodiment of the present invention.

Carrier block 312 is supported (as shown in FIG. 9) rotatably around and slidably along the carrier shaft 4 at the distal end 4*b* (opposite to the base plate). The carrier block 312 is formed by severing a hollow cylinder by a pair of parallel planes arranged in the axial direction. As shown in FIG. 9, a pair of L-shaped carrier plates 310, 310 are secured through their perpendicular portions onto the severed sections of the carrier block 312, and oppose to each other through their horizontal portions around the axis.

Figure 6:
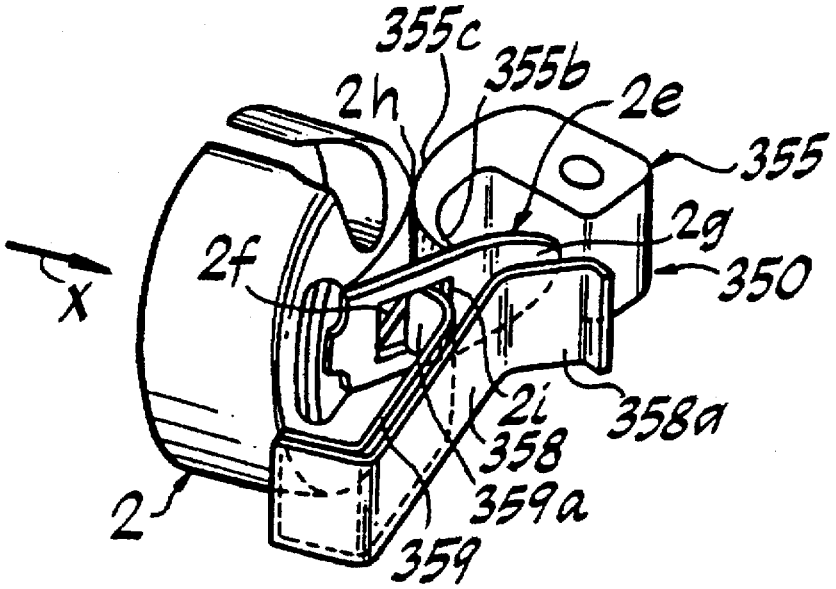
FIG. 6 is a perspective view of grip mechanism of an embodiment of the present invention.
Figure 7:
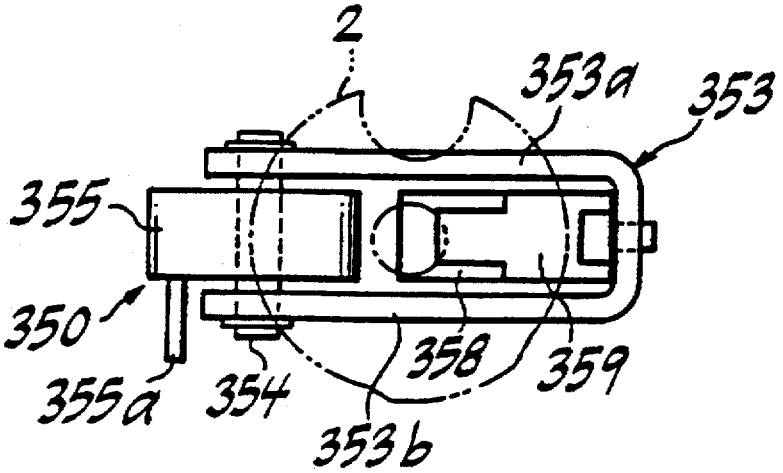
FIG. 7 is a view of the grip mechanism in FIG. 6 viewed from the direction X.
Figure 8A:
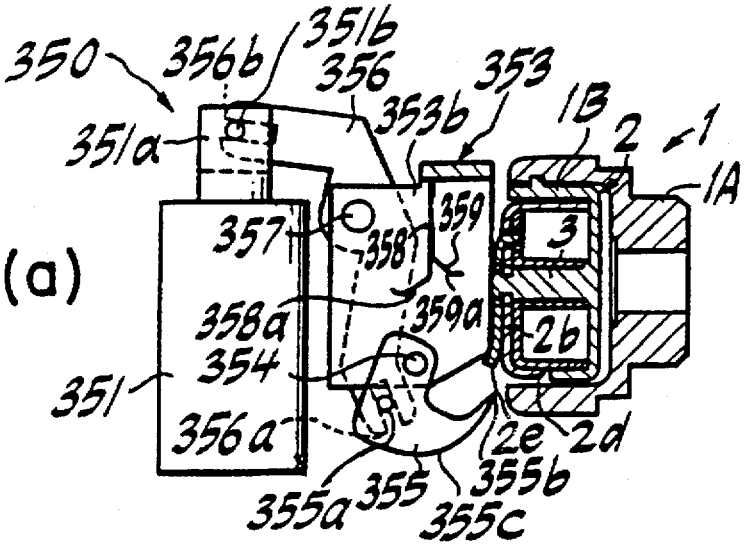
FIGS. 8(*a*) through 8(*c*) are views for explaining operations of the grip mechanism.
Figure 8B:
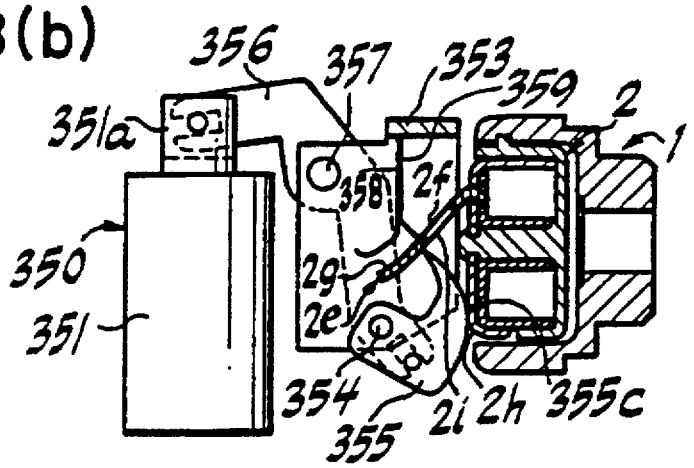
Figure 8C:
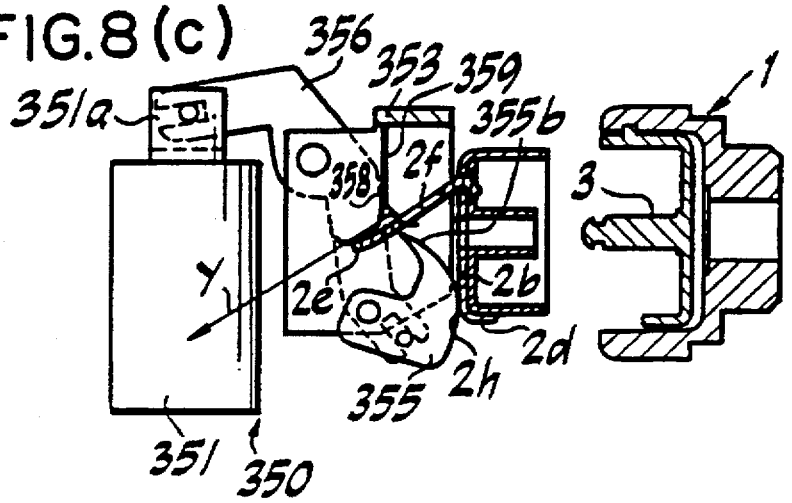

Each of a pair of L-shaped holders 311, 311 has grip mechanism 350 shown in FIGS. 6 through 8 at its distal end (which faces the shuttle 1). Hereupon, FIGS. 9 through 14 do not illustrate the grip mechanism 350 to prevent the drawings from being complicated. The grip mechanism 350 will be discussed with reference to FIGS. 6 through 8(*c*) below.

Each holder 311 is fixed, as shown in FIGS. 7 through 8(*c*), onto U-shaped support plate 353 which opens in the lower direction in FIGS. 8(*a*) through 8(*c*) and spans nail shaft 354 rotatably between both side plates 353*a*, 353*b*. The nail shaft 354 supports nail 355 by which the lock lever 2*e* of the bobbin case 2 is pulled up from a position (illustrated in FIG. 8(*a*)) and set to an open position (in FIG. 8(*c*)). The nail 355 has an arc shape and is to be inserted through top portion 355*b* thereof between the lock lever 2*e* and the bobbin stopper plate 2*b* of the bobbin case 2.

The nail 355 projects (in the lower direction in FIGS. 8(*a*) through 8(*c*)) from the side plates 353*a*, 353*b*, and the projecting portion is pinned with pin 355*a* from the surface facing the side plate 353*b*. Link shaft 357 penetrates through the outer surface of the side plate 353*b*, and supports bent link 356 rotatably. Both ends of the link 356 are notched to form notches 356*a*, 356*b*, respectively; the notch 356*a* loosely receives the pin 355*a* of the nail 355 and the notch 356*b* receives pin 351*b* at plunger 351*a* of solenoid 351. The solenoid 351 is fixed to the holder 311.

The support plate 353 fixes thereon, as shown in FIGS. 6, 8(*a*) through 8(*c*), plate spring 358 which functions as a first elastic member between the side plates 353*a*, 353*b* and extends to the nail 355, and plate spring 359 as a second elastic member. Top 359*a* of the plate spring 359 is bent to the bobbin case 2; it is able to be inserted into window 2*f* of the lock lever 2*e* after the lock lever 2*e* is pulled up by the nail 355, and engaged with frame 2*i* of the window 2*f*. It also has a predetermined aperture as an idle space for lock lever 2*e* when the second elastic member 359 receives the window 2*f* in the longitudinal direction in FIG. 6.

Top 358*a* of the plate spring 358 is bent in the direction opposite to that of the top 359*a* of the plate spring 359, and is to support outer surface 2*g* of the lock lever 2*e* pulled up by the nail 355. The plate spring 358, 359, receive, hold, and fix the lock lever 2*e* at an open state through the compression force from the nail 355, thereby the bobbin case 2 is held entirely.

In FIG. 8(*a*), numeral 1A denotes an outer shuttle, and numeral 1B denotes a center shuttle.

Figure 10:
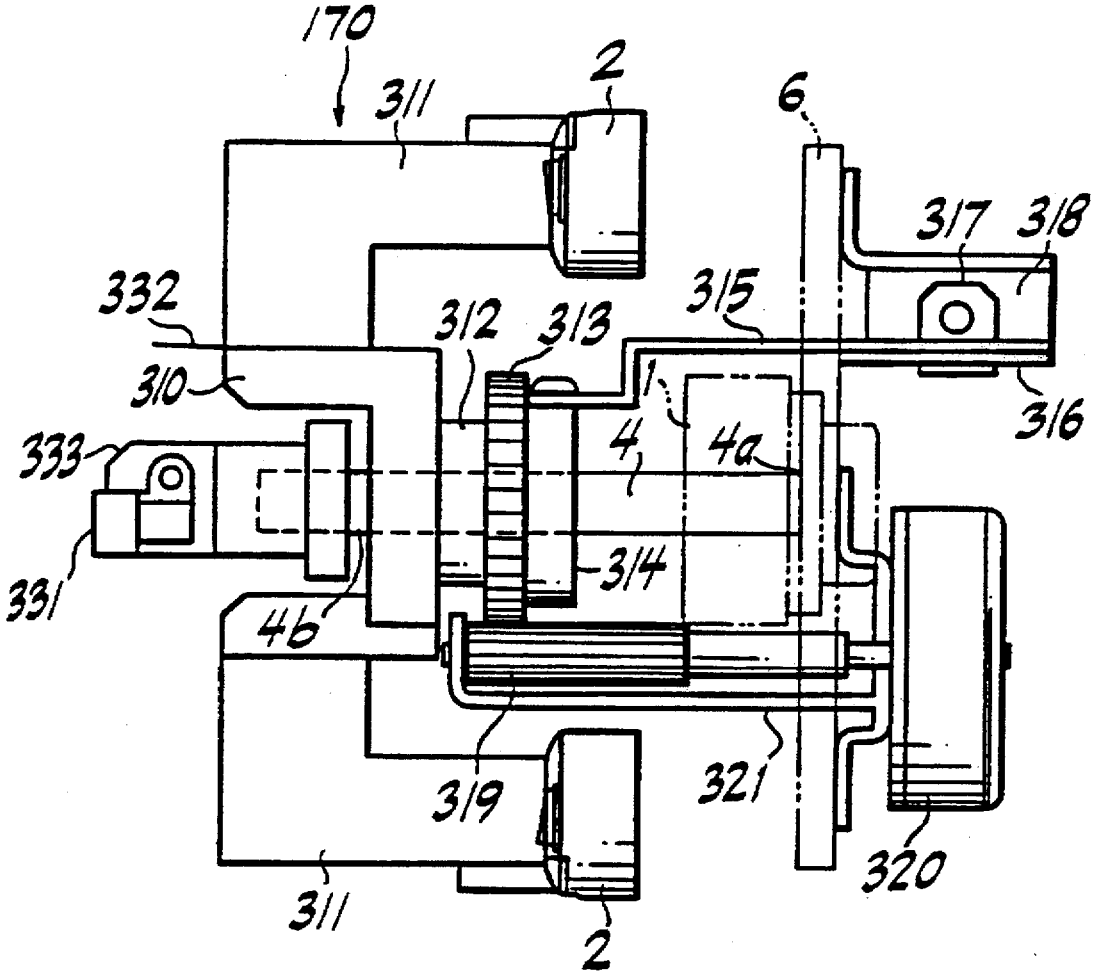
FIG. 10 is a plan view of the bobbin exchanger.

Rotary gear 313 is provided at the circumference of the carrier block 312, as shown in FIGS. 9 through 12, and engaged with drive gear 319 which elongates in the direction of the rotary shaft 21, as shown in FIG. 10. One end of the drive gear 319 is rotatably supported by a part of motor lock plate 321 mounted on the base plate 6 which part projects to the other end of the carrier shaft. The other end of the drive gear 319 is associated with an output shaft of rotary motor 320 fixed on the motor lock plate 321.

Thus, the rotary arm 170 which includes the carrier block 312, carrier plates 310, 310, and holders 311, 311 rotates, as the rotary motor 320 rotates, via the drive gear 319 and rotary gear 313. According to the third embodiment, the rotary arm 170 rotates only when it is located at an evacuation position (shown in FIG. 10 through 12). Although the carrier shaft 4 is overhung, it has the sufficient support strength as guided by the drive gear 319.

A stop ring (not shown) is secured to the circumference of the carrier block 312 which is closer to the fixed end of the carrier shaft 4 than the rotary gear 313, and linear collar 314 is rotatably supported between the rotary gear 313 at the circumference of the carrier block 312 and the stop ring.

Figure 11:
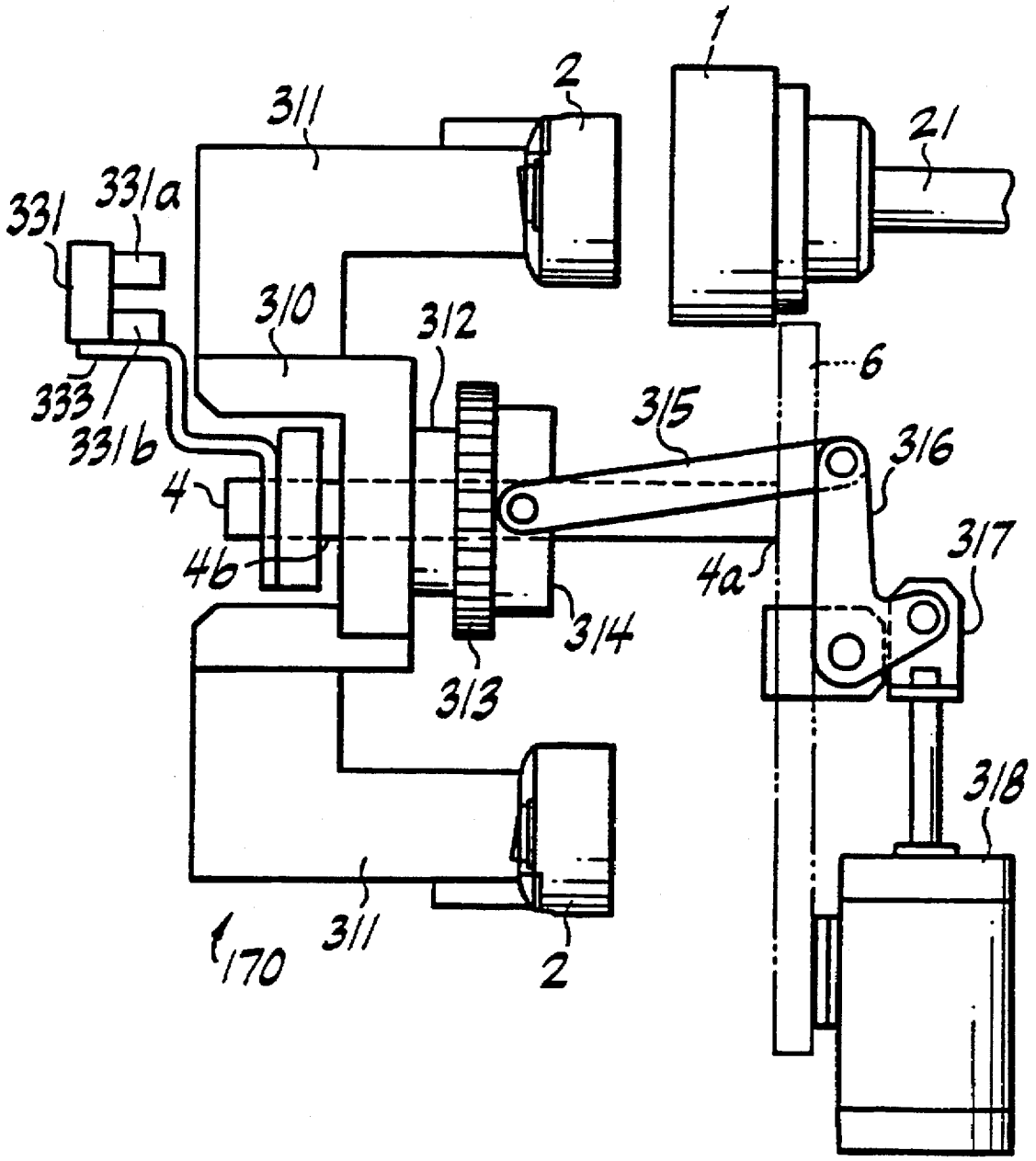
FIG. 11 is a left side view of the bobbin exchanger.
Figure 12:
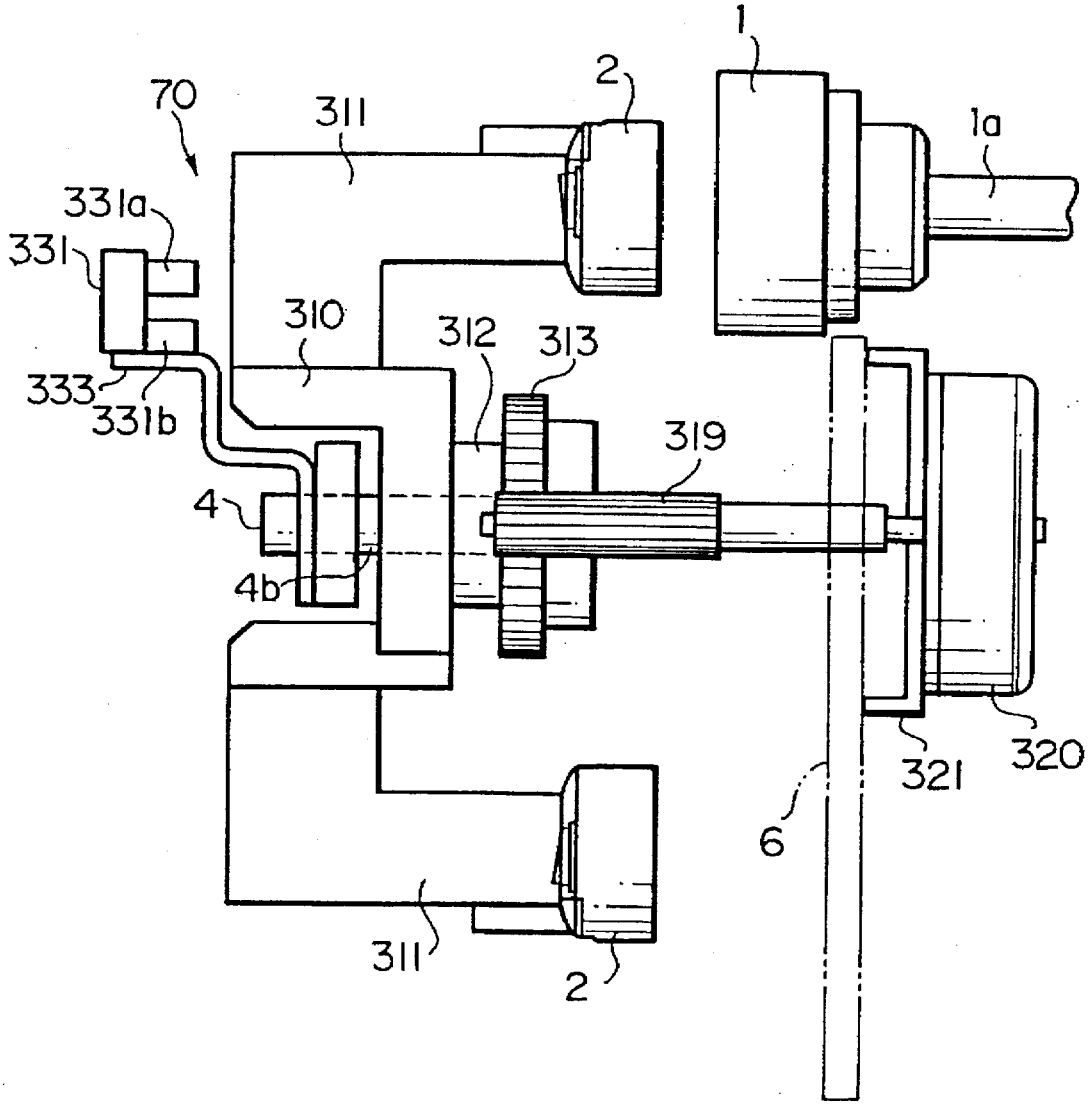
FIG. 12 is a right side view of the bobbin exchanger.

The linear collar 314 is coupled to one end of linear link 315, as shown in FIG. 11. The other end of the linear link 315 is coupled to one end of bent drive link 316. The bent portion of the drive link 316 is secured to a bracket mounted on the base plate 6. The other end of the drive link 316 is coupled to knuckle 317 of air cylinder 318 mounted on the base plate 6.

When the air cylinder 318 is driven, the rotary arm 170 moves together with the linear collar 314 in the axial direction of the carrier shaft 4 via the knuckle 317, the drive link 316, and the linear link 315. Therefore, the rotary arm 170 is rotatable around and slidable along the carrier shaft 4.

Sensor lock plate 333 is attached rotatably to the free end of the carrier shaft 4, and rotary sensor 331 which comprises light emitting element 331*a* and light receiving element 331*b* is attached to the sensor clamp plate 333. The rotary arm 170 has, as shown in FIGS. 9 and 10, sensor plate 332 which is designed to pass between the light emitting element 311*a* and light receiving element 311*b* when the rotary arm 170 rotates.

Figure 13:
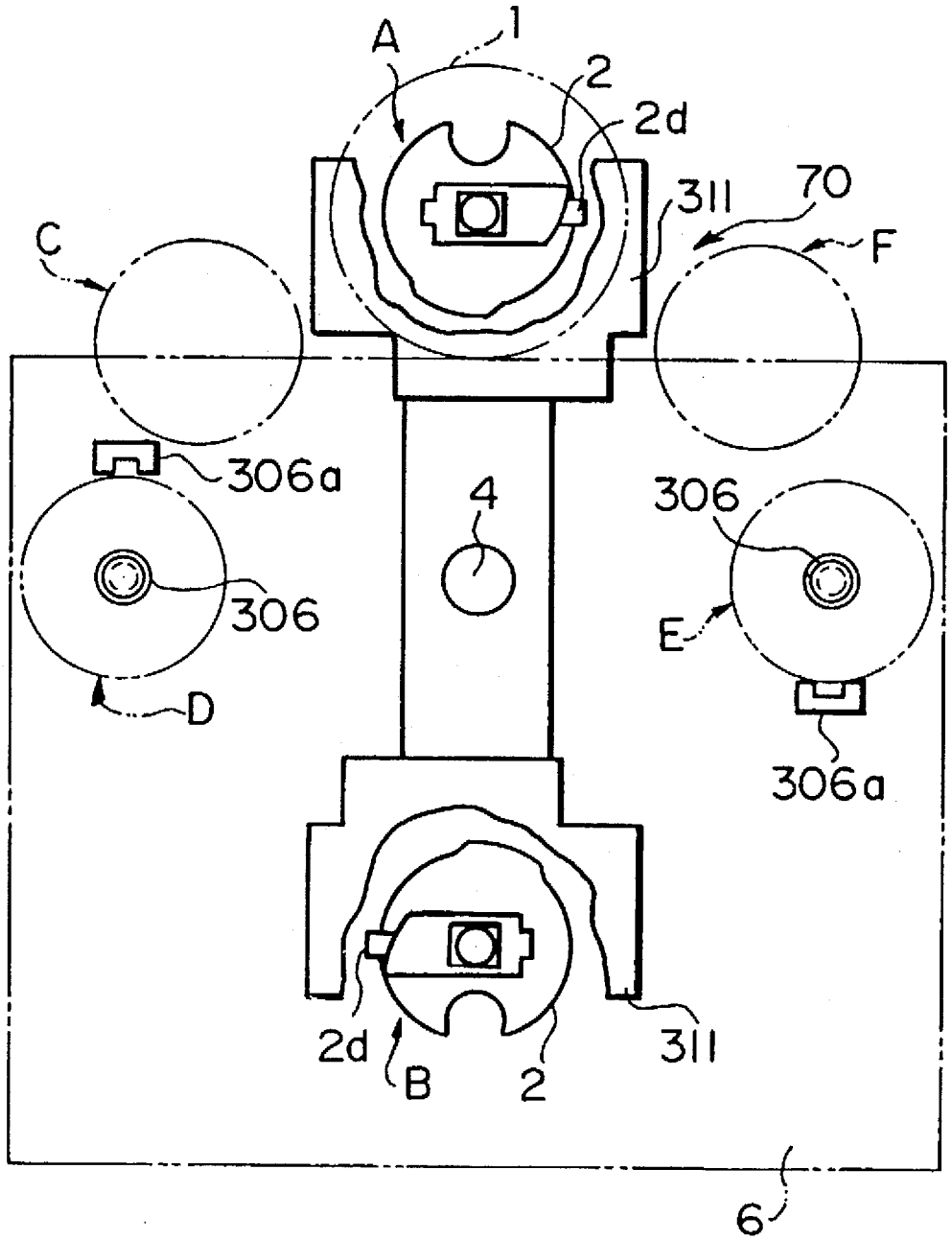
FIG. 13 is a schematic front view for explaining a dummy position and a dummy shaft of the bobbin exchanger.
Figure 14:
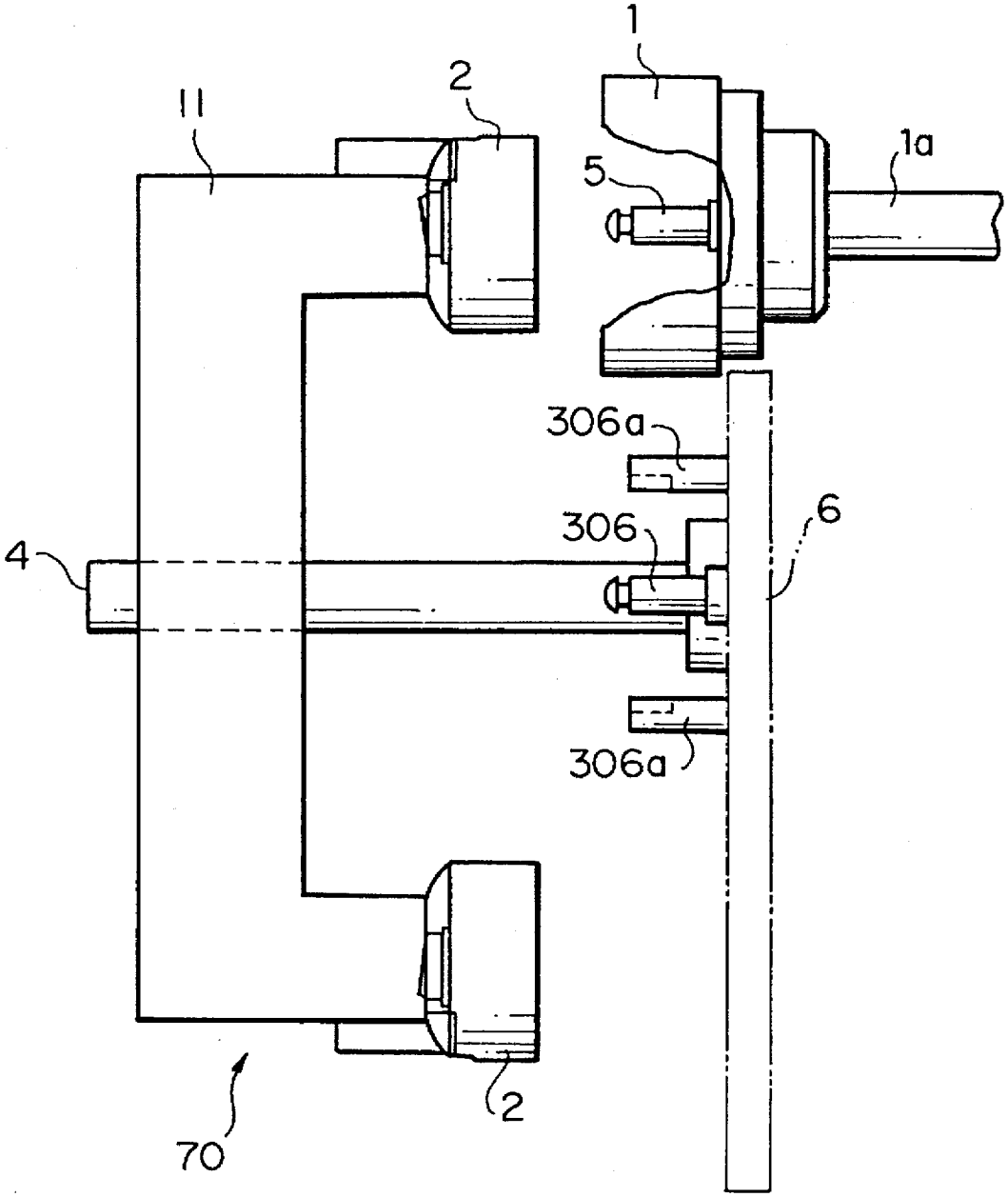
FIG. 14 is a schematic side view for explaining a dummy position and a dummy shaft of the bobbin exchanger.
Figure 15:
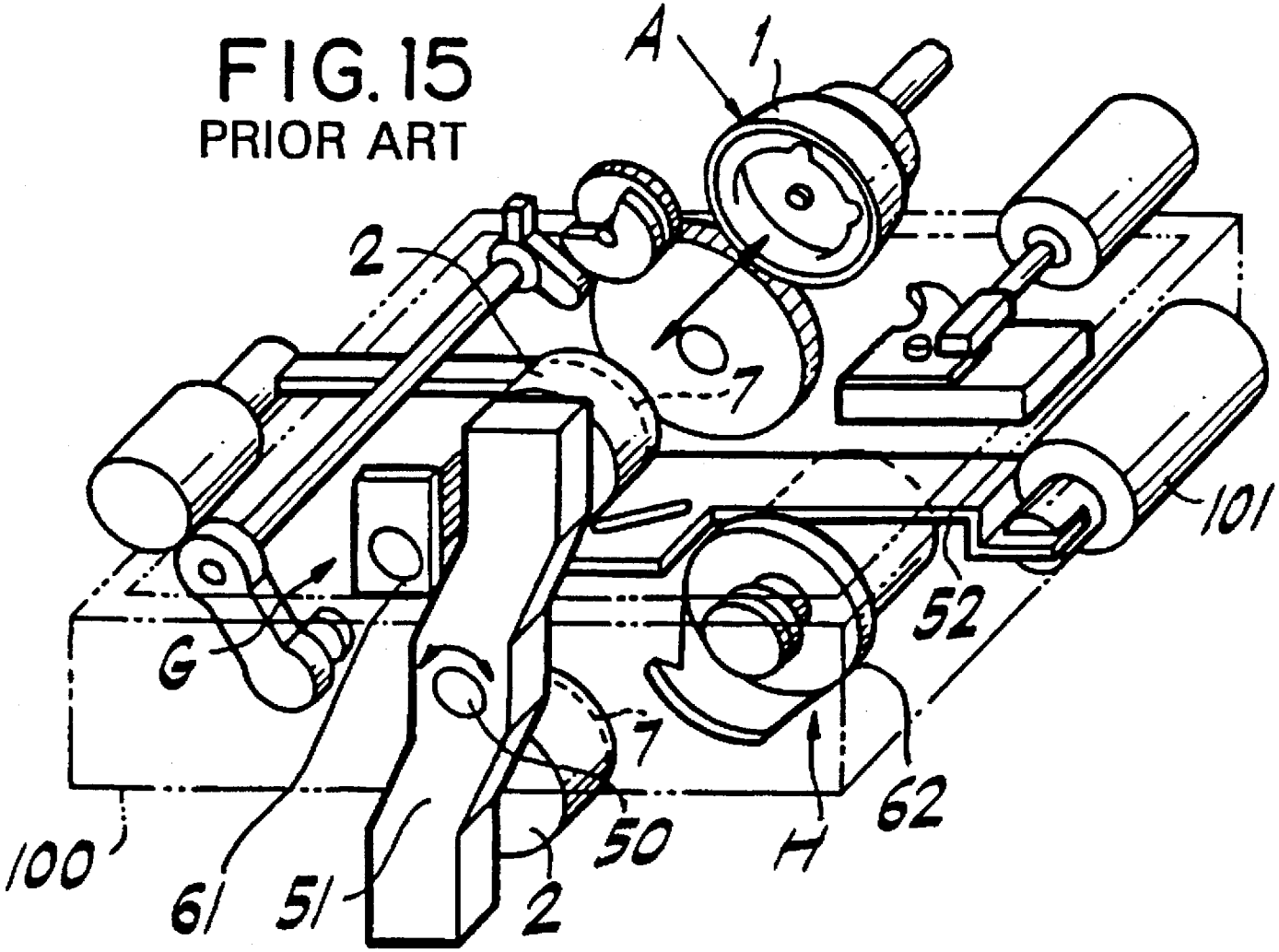
FIG. 15 PRIOR ART
FIG. 15 is a schematic perspective view of a lower-thread automatic supplying unit which is to be applied to a prior art bobbin exchanger.
Figure 16:
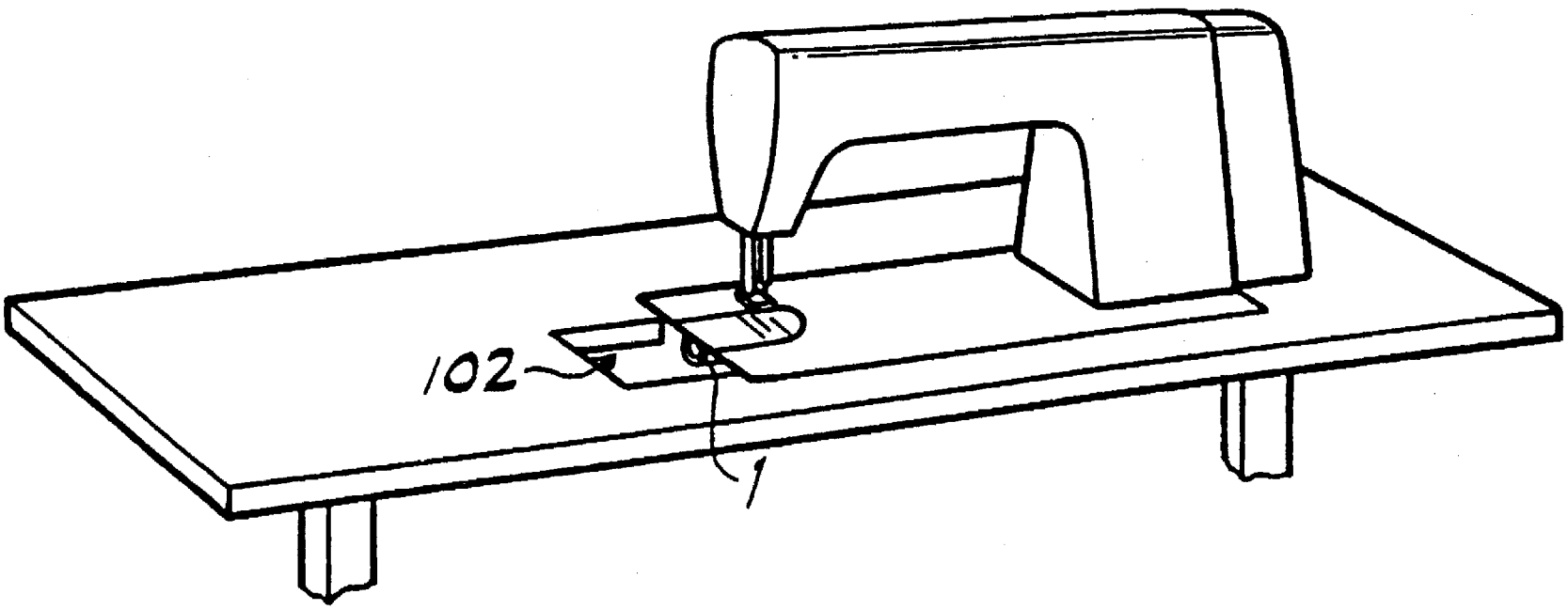
FIG. 16 PRIOR ART
FIG. 16 is a perspective view of a table including a sewing machine thereon.

As shown in FIG. 13, a pair of dummy shafts 306 as bobbin-case holding mechanism are arranged at positions opposable to the rotated grip mechanism, for instance, positions D and E, on the base plate 6. Each dummy shaft 306 has the same structure as that of the top of the middle-shuttle shaft 3, as shown in FIG. 14, and is to hold the bobbin case 2 as the bobbin case 2 with a bobbin is loaded. As shown in FIG. 13, the bobbin stopper tab 2*d* of the loaded bobbin case 2 is engaged with a stopper groove of stopper member 306*a* near the dummy 306. Thus, the bobbin case 2 is positioned at a predetermined position and held there.

As shown in FIG. 13, the remaining-thread remover and the lower-thread winder are arranged at the positions opposable to the rotated grip mechanism, e.g., the positions C and F, respectively.

A description will now be given of operations of the device. Initially, it is attempted to make a pair of grip mechanism 350*a*, 350*b* (where the numeral 350 is followed by "a" and "b" for descriptive convenience) hold a pair of bobbin cases with a fully wound lower-thread bobbin. Therefore, the operator pulls his hand from the rotary-arm side, loads the bobbin cases into the middle-shuttle shaft 3 and compresses, without turning his palm, the bobbin cases onto a pair of dummy shafts 306, 306. The manual loading of the bobbin case into the dummy shafts 306, 306 is very easy.

As the power switch is turned on, the rotary arm 170 returns to the origin. Since the solenoid 351 is not electrified this time, the top portion 355*b* of the nail 355 is located at the evacuation point and the lock lever 2*e* of the bobbin case 2 is located at the close position, as shown in FIG. 8(*a*). As the start switch is turned on, the rotary arm 170 rotates and the grip mechanism 350*a* opposes to the dummy position D or E. As the rotary arm 170 advances, the grip mechanism 350*a* holds the bobbin case with a fully wound lower-thread bobbin at the dummy shaft 306. Although FIGS. 8(*a*) through 8(*c*) show a sequence to remove the bobbin case 2 from the middle-shuttle shaft 3, the middle-shuttle shaft 3 may be replaced with the dummy shaft 306.

As the plunger 351*a* of the solenoid 351 moves downwardly, the nail 355 in FIG. 8(*a*) rotates to the open direction and enters, through the top portion 355*b*, the lock lever 2*e* of the bobbin case 2 at the close position, whereby the lock lever 2*e* rises from the close position and opens. The rear surface 355*c* of the nail 355 receives outer surface 2*h* of the bobbin case 2, as shown in FIGS. 6 and 8(*b*). When the released lock lever 2*e* is held at the open position, the top 359*a* of the plate spring 359 is inserted into the window 2*f* of the released lock lever 2*e* and engaged with the frame 2*i* of the window 2*f*, thereby compressing the lock lever 2*e* in the direction Y in FIG. 8(*c*). Simultaneously, the top 358*a* of the plate spring 358 receives the outer surface 2*g* of the released lock lever 2*e*. The lock lever 2*e* is compressed, while being released, and held by the compression force of the nail 355 against the plate springs 358, 359, whereby the bobbin case 2 is wholly held by the grip mechanism 350. Since the lock lever 2*e* is maintained to be released, the bobbin case 2 becomes ejectable from the dummy shaft 306 and the bobbin is held without being dropped from the bobbin case 2. Finally, as shown in FIG. 8(*c*), the grip mechanism 350 retreats.

Since the three-dimensional elastic transforms of the plate springs 358, 359 absorbs a centering offset, if any, between the dummy shaft 306 and the grip mechanism 350, when removing the bobbin case 2 from the dummy shaft 6, the bobbin case 2 is removed from the dummy case 306 without fail. Such a structure permits the rough positioning between the dummy shaft 306 and the grip mechanism 350, and shortens the conventional precise positioning assembly time. Secondly, the elastic transforms of the plate springs 358, 359 in the open position absorbs the different opening angle of the lock lever 2*e* of each bobbin case 2, and satisfactorily releases the lock lever 2*e*. Therefore, the tab 2*d* of the bobbin case 2 grasps the bobbin definitely, and prevents the bobbin from being left alone. Thirdly, the three-dimensional elastic transforms of the plate springs 358, 359 facilitates the lock lever 2 to be held securely between the nail 355 and the plate springs 358, 359. Therefore, such a structure permits the rough positioning among these components, and reduces the conventional precise positioning assembly time.

A description turning back to the operation, the rotary arm 170, which has retreated to the evacuation position, rotates. As a consequence, the grip mechanism 350*a* which holds the fully wound bobbin case is opposed to the shuttle 1 and advanced to load the bobbin case into the shuttle 1.

The grip mechanism 350*a* loads the bobbin case in accordance with the procedures reverse to those shown in FIGS. 8(*a*) through 8(*c*): When the bobbin case 2 is inserted into the shuttle 1, the solenoid 351 is released from being electrified. As a result, the nail 355 of the grip mechanism 350*a* is released, and the bobbin case 2 is loaded into the shuttle 1.

The three-dimensional elastic transforms of the plate springs 358, 359 while the bobbin case 2 is loaded into the shuttle 1 absorbs the centering offset, if any, between the shuttle 1 and the grip mechanism 350, and the bobbin case 2 is definitely loaded into the dummy case 306.

After the rotary arm 170 retreats and the sewing operations are initiated, the other grip mechanism (i.e., 350*b*) holds the bobbin case which houses a wound lower-thread bobbin at the dummy shaft 306 and the rotary arm 170 retreats during the sewing operations in the similar procedures to those discussed above.

When a bobbin exchange command is issued, for example, because the bobbin remaining thread in the shuttle is lessened, the sewing operation is interrupted. Then, the rotary arm 170 rotates to oppose the grip mechanism 350*a* without any bobbin case to the shuttle 1 and advances to remove the bobbin with a small amount of lower thread.

The grip mechanism 350*a* removes the bobbin case in the similar procedures shown in FIGS. 8(*a*) through 8(*c*). Therefore, the removal of the bobbin case from the shuttle 1 by the grip mechanism 350*a* has the same effects as those of the removal of the bobbin case from the dummy shaft 6 by the grip mechanism 350.

Thereafter, the rotary arm 170 retreats and rotates to oppose to the shuttle 1 the bobbin case with a fully wound lower-thread bobbin, advances to load the bobbin case into the shuttle 1, and retreats again. When the sewing operations are initiated, the rotary arm 170 rotates during the sewing operations to oppose the bobbin having a small amount of lower thread to the remaining-thread remover. The remaining thread on bobbin is removed by the remaining-thread remover and thus the bobbin is made empty. Next, the rotary arm 170 rotates until the empty bobbin is opposed to the lower-thread winder, and then advances, whereby the lower-thread winder winds lower thread around the bobbin, threads the bobbin case, and cut the lower thread.

When the lower thread is sufficiently wound around the bobbin, the rotary arm 170 retreats and stands by. In response to the next bobbin exchange command, the sewing operation is interrupted and the rotary arm 170 rotates until the grip mechanism 350*b* without any bobbin case is opposed to the shuttle 1. After the bobbin having a small amount of lower thread is removed from the shuttle 1, the rotary arm 170 retreats. The rotary arm 170 then rotates and advances. When the bobbin which is wound by the lower-thread winder is loaded into the shuttle 1, the rotary arm 170 retreats. The aforementioned procedures will be repeated as the following steps.

Meanwhile, in an attempt to take off the bobbin case 2 from the holding mechanism 350 or temporarily store the bobbin case 2 at the dummy shaft 6 for the different color lower thread, the grip mechanism 350 with the bobbin case 2 opposes to the dummy shaft 306 and then advances, whereby the bobbin case 2 is delivered from the holding mechanism 350 to the dummy shaft 306. Thus, the loading of the bobbin case by the grip mechanism 350 into the dummy shaft 306 has the same effects as those of loading of the bobbin case by the grip mechanism 350 into the shuttle 1.

The present invention is not limited to these preferred embodiments, and various variations and modifications may be made within the scope of the present invention. For instance, the plate spring 359 in the above embodiments may be substituted with sectionally U-shaped plate spring which holds at least a pair of edges of the lock lever 2*e* pulled up by the nail 355. The plate spring receives the outer surface 2*g*. Such a structure achieves the same effects as those obtained in the above embodiments. The edges of the lock lever 2*e* may be received, rather than being held.

Although the above embodiments employs the plate springs 358, 359 to hold the lock lever 2*e* in cooperation with the nail 355 for the reason of their effects, only one of the plate springs 358, 359 may be used to achieve the necessary effect. In addition, these plate springs 358, 359 may be molded as one member to reduce the number of components. Moreover, other elastic member other than a plate spring may be used.

The bobbin-case holding mechanism may be composed, other than the dummy shaft 306, of a magnet which magnetically absorbs the bobbin case 2 to house and hold it in a holder.

The dummy positions D and E, the lower-thread winding position F, and the remaining-thread removing position C are not limited to those positioned as specified in the above embodiments as long as they are opposable to the moved grip mechanism 350.

While there have been shown and described and pointed out fundamental novel features of the invention as applied to currently preferred embodiments thereof, it will be understood that various omissions and substitutions and changes in the form and details of the devices illustrated, and in their operations, may be made by those skilled in the art without departing from the spirit of the invention. It is the invention, therefore, to be limited only as indicated by the scope of the claims appended thereto.

What is claimed is:

1. A bobbin exchanger for use with a sewing machine, the sewing machine which includes a shuttle to receive a bobbin case for sewing operations, said bobbin exchanger comprising:

an overhung shaft;

a rotary member supported by said overhung shaft movably along and rotatably around said overhung shaft; and a grip mechanism, coupled to said rotary member, which releasably holds the bobbin case to load the bobbin case into or eject the same from the shuttle in association with moving and rotating operations of said rotary member.

2. The bobbin exchanger of claim 1, wherein said rotary arm is connected to the sewing machine, whereby said rotary arm supplementarily supports a free end of said overhung shaft.

3. The bobbin exchanger of claim 1, wherein said overhung shaft is offset from the shuttle of the sewing machine.

4. The bobbin exchanger of claim 1, further comprising a motor which moves said rotary member along said overhung shaft.

5. The bobbin exchanger of claim 1, wherein said said rotary member includes a rotary arm having two ends, one end of which is coupled to said grip mechanism and the other end of which is supported by said overhung shaft.

6. The bobbin exchanger of claim 1, wherein said rotary member includes a carrier block disposed rotatably around and movably along said overhung shaft, and wherein said carrier block is formed by severing a hollow cylinder with a pair of parallel planes arranged in an axial direction of the cylinder.

7. The bobbin exchanger of claim 1, further comprising an actuator which moves said rotary member along said overhung shaft.

8. A bobbin exchanger for use with a sewing machine, the sewing machine which includes a shuttle to receive a bobbin case for sewing operations, said bobbin exchanger comprising:

an overhung shaft;

a rotary member supported by said overhung shaft movably along and rotatably around said overhung shaft; and a grip mechanism, coupled to said rotary member, which releasably holds the bobbin case to load the bobbin case into or eject the same from the shuttle in association with moving and rotating operations of said rotary member, wherein said grip mechanism is arrangeable opposite to the shuttle, and wherein said overhung shaft includes a free end and supporting said rotary member with said grip mechanism around the free end.

9. A bobbin exchanger for use with a sewing machine, the sewing machine which includes a shuttle to receive a bobbin case for sewing operations, said bobbin exchanger comprising:

an overhung, shaft:

a rotary member supported by said overhung shaft movably along and rotatably around said overhung shaft;

a grip mechanism, coupled to said rotary member, which releasably holds the bobbin case to load the bobbin case into or eject the same from the shuttle in association with moving and rotating operations of said rotary member;

a first gear provided around said overhung shaft and coupled to said rotary member; and a second gear, engaged with said first gear, which has teeth long enough in a direction parallel to said overhung shaft to guide the rotary member to move along said overhung shaft.

10. The bobbin exchanger of claim 9, wherein said rotary member includes a carrier bush rotatably around and movably along said overhung shaft, and wherein said first gear is coupled to said carrier bush.

11. The bobbin exchanger of claim 9, further comprising:

a linear member, which is supported rotatably around and unmovably along said overhung shaft and coupled to said rotary member;

a rack provided with said linear member; and a pinion, engaged with and rotated by said rack, which moves said rack with said linear member along the overhung shaft, whereby said rotary member moves along said overhung shaft, said rack and pinion being arranged at a side opposite to said second gear around said overhung shaft.

12. A bobbin exchanger for use with a sewing machine, the sewing machine which includes a shuttle to receive a bobbin case for sewing operations, said bobbin exchanger comprising:

an overhung shaft;

a rotary member supported by said overhung shaft movably along and rotatably around said overhung shaft;

a grip mechanism, coupled to said rotary member, which releasably holds the bobbin case to load the bobbin case into or eject the same from the shuttle in association with moving and rotating operations of said rotary member;

a linear member, which is supported rotatably around and unmovably along said overhung shaft and coupled to said rotary member;

a rack provided with said linear member; and a pinion, engaged with and rotated by said rack, which moves said rack with said linear member along said overhung shaft, whereby said rotary member moves along said overhung shaft.

13. The bobbin exchanger of claim 12, wherein said rotary member includes a carrier bush rotatably around and movably along said overhung shaft, and said linear member is rotatably disposed around said carrier bush and unmovable along the carrier bush.

14. A bobbin exchanger for use with a sewing machine, the sewing machine including a shuttle to receive a bobbin case for sewing operations, said bobbin exchanger comprising:

a grip mechanism which releasably holds the bobbin case to load the bobbin case into or eject the bobbin case from the shuttle;

a remaining-thread remover which receives the bobbin case from said grip mechanism, and removes lower thread remaining around a bobbin in the bobbin case;

a lower-thread winder which receives the bobbin cast from said grip mechanism, and winds up lower thread around the bobbin in the bobbin case;

a holding mechanism for receiving the bobbin case from said grip mechanism, for temporarily holding the bobbin case, and for assisting said grip mechanism in a replacement of the bobbin case; and means for transferring said grip mechanism among the shuttle, said remaining-thread remover, said lower-thread winder, and a temporarily holding position by said holding mechanism.

15. The bobbin exchanger of claim 14, wherein said holding mechanism includes at least two dummy shafts, and wherein said remaining-thread remover receives the bobbin case from said dummy shaft, removes lower thread remaining around a bobbin in the bobbin case, and returns the bobbin case to said dummy shaft, said remaining thread-remover being positioned in one of said dummy shaft.

16. A bobbin exchanger for use with a sewing machine, the sewing machine including a shuttle to receive a bobbin case for sewing operations, said bobbin exchanger comprising:

a grip mechanism which releasably holds the bobbin case to load the bobbin case into or eject the bobbin case from the shuttle;

mobile means, coupled to said grip mechanism, for linearly moving said grip mechanism two-dimensionally; and a holding mechanism for receiving the bobbin case from said grip mechanism, for temporarily holding the bobbin case, and for assisting said grip mechanism in a replacement of the bobbin case.

17. The bobbin exchanger of claim 16, wherein said holding mechanism includes at least two dummy shafts, and wherein said bobbin exchanger further comprises a remaining-thread remover, which receives the bobbin case from said dummy shaft, removes lower thread remaining around a bobbin in the bobbin case, and returns the bobbin case to said dummy shaft, said remaining thread-remover being positioned in one of said dummy shaft.

18. A bobbin exchanger for use with a sewing machine, the sewing machine including a shuttle to receive a bobbin case for sewing operations, said bobbin exchanger comprising:

an overhung shaft;

a rotary member supported by said shaft movably along and rotatably around said shaft;

a grip mechanism, coupled to said rotary member, which releasably holds the bobbin case to load the bobbin case into or eject the bobbin case from the shuttle in association with moving and rotating operations of said rotary member; and a holding mechanism for receiving the bobbin case from said grip mechanism and for temporarily holding the bobbin case, said holding mechanism assisting said grip mechanism in a replacement of the bobbin case.

19. The bobbin exchanger of claim 18, wherein said rotary member has a rotary arm having two ends, one end of which is coupled to said grip mechanism and the other end of which is supported by said shaft.

20. A bobbin exchanger for use with a sewing machine, the sewing machine including a shuttle to receive a bobbin case for sewing operations, said bobbin exchanger comprising:

an overhung shaft;

a rotary member supported by said shaft movably along and rotatably around said shaft;

a grip mechanism, coupled to said rotary member, which releasably holds the bobbin case to load the bobbin case into or eject the bobbin case from the shuttle in association with moving and rotating operations of said rotary member; and a holding mechanism for receiving the bobbin case from said grip mechanism and for temporarily holding the bobbin case, said holding mechanism assisting said grip mechanism in a replacement of the bobbin case.

wherein said grip mechanism is able to be arranged opposite to the shuttle, said overhung shaft including a free end and supporting said rotary member with said grip mechanism around the free end.

21. A bobbin exchanger for use with a sewing machine having a shuttle to receive a bobbin case for sewing operations, said bobbin exchanger comprising:

a grip mechanism which holds the bobbin case by pulling up a lock lever of the bobbin case to an open position and releases the bobbin case by returning the lock lever to a close position so as to load the bobbin case into or eject the bobbin case from the shuttle means, coupled to said grip mechanism, for transferring said grip mechanism, wherein said grip mechanism includes:

a tab which pulls up the lock lever to the open position; and a first elastic member which receives the lock lever which has been pulled up by the tab so as to hold the lock lever at the open position.

22. The bobbin exchanger of claim 21, where the lock lever has a hole and said grip mechanism further includes a second elastic member which is engageable with the hole of the lock lever which has been pulled up by said tab so as to hold the lock lever at the open position.

23. The bobbin exchanger of claim 21, wherein said first and second elastic members are incorporated with each other.

24. A bobbin exchanger for use with a sewing machine having a shuttle to receive a bobbin case for sewing operations, said bobbin exchanger comprising:

a grip mechanism which holds a bobbin case by pulling up a lock lever of the bobbin case to an open position and releases the bobbin case by returning the lock lever to a close position so as to load the bobbin case into or eject the same from a shuttle in the sewing machine, said lock lever having a hole; and mobile means, coupled to said grip mechanism, for moving said grip mechanism, wherein said grip mechanism includes:

a tab which protrudes between the lock lever and pulls up the lock lever to the open position; and an elastic member which is engageable with the hole of the lock lever which has been pulled up by said tab so as to hold the lock lever at the open position.

* * * * *

UNITED STATES PATENT AND TRADEMARK OFFICE

CERTIFICATE OF CORRECTION

PATENT NO. : 5,718,181

DATED : February 17, 1998

INVENTOR(S) : Toshinobu Shinozuka et al.

It is certified that error appears in the above-indentified patent and that said Letters Patent is hereby corrected as shown below:

Column 10, line 1, change "position" to -- close position --

Column 15, line 59, change "cast" to -- case --

Signed and Sealed this

Eleventh Day of August 1998

Bruce Lehman

*Attest:*

BRUCE LEHMAN

*Attesting Officer*

*Commissioner of Patents and Trademarks*